US005920914A

United States Patent [19]

Dempsey

[11] Patent Number: 5,920,914

[45] Date of Patent: Jul. 13, 1999

[54] PROTECTIVE MALE UNDERGARMENT

[76] Inventor: Kate B. Dempsey, 152 College La., Mobile, Ala. 36608

[21] Appl. No.: 09/004,488

[22] Filed: Jan. 8, 1998

[51] Int. Cl.[6] ..... A41B 9/02

[52] U.S. Cl. ..... 2/403; 2/400

[58] Field of Search ..... 2/400, 403, 405, 2/227, 228, 238; 602/67–73

[56] References Cited

U.S. PATENT DOCUMENTS

| | | | |
|---|---|---|---|
| 1,720,439 | 7/1929 | Richardson . | |
| 2,623,210 | 12/1952 | Chatfield . | |
| 3,037,503 | 6/1962 | Ravaschieri . | |
| 3,141,458 | 7/1964 | Burbank | 2/403 |
| 3,229,692 | 1/1966 | Creed . | |
| 3,788,314 | 1/1974 | Noreen | 602/72 |
| 4,014,044 | 3/1977 | Figueroa et al. . | |
| 4,035,844 | 7/1977 | Atack et al. . | |
| 4,141,357 | 2/1979 | Dietz . | |
| 4,156,294 | 5/1979 | Horn | 2/400 |
| 5,070,869 | 12/1991 | Zhang | 602/72 |
| 5,093,935 | 3/1992 | Countee, Jr. . | |
| 5,134,726 | 8/1992 | Ross . | |
| 5,172,430 | 12/1992 | Lerma-Solis . | |
| 5,243,974 | 9/1993 | Allen . | |
| 5,274,854 | 1/1994 | Wenner et al. | 2/403 |
| 5,295,267 | 3/1994 | Galindo . | |
| 5,483,705 | 1/1996 | DiMatteo . | |

*Primary Examiner*—Gloria Hale
*Attorney, Agent, or Firm*—Needle & Rosenberg, PC

[57] ABSTRACT

A protective undergarment for use by athletes, which includes a body portion, a pouch for retaining a protective cup in position over the wearer's groin, and a slit through the body portion alongside the pouch, for allowing the wearer to urinate without removing or lowering the garment.

20 Claims, 1 Drawing Sheet

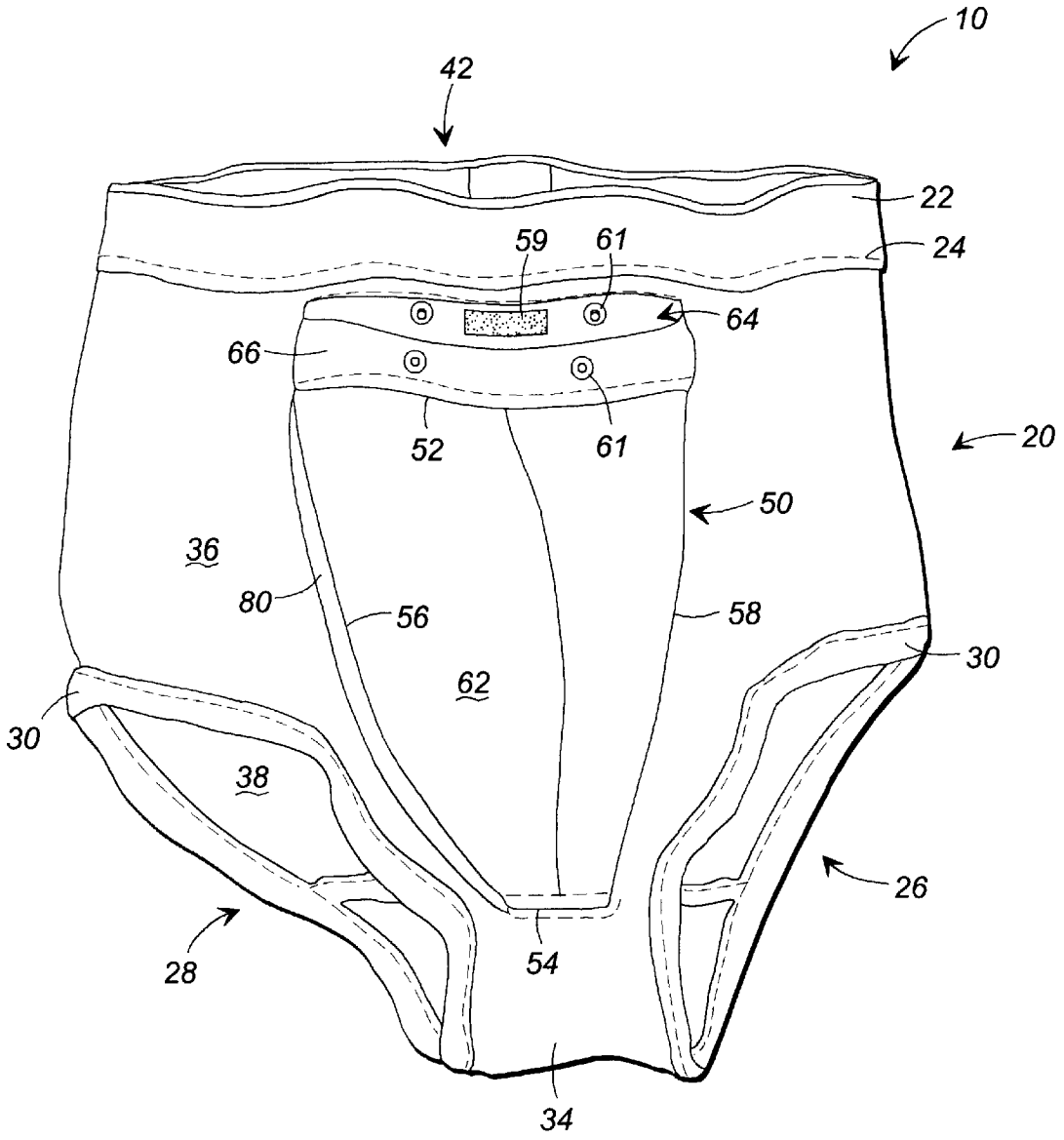
10
42
22
24
59
61
64
66
52
61
20
50
36
80
56
58
30
62
30
38
26
28
54
34

PROTECTIVE MALE UNDERGARMENT

BACKGROUND OF THE INVENTION

1. Field of the Invention

The present invention relates to a protective undergarment for males, and more particularly to a brief-style underpant having a pouch for receiving a protective athletic cup, and a slit adjacent the pouch to allow the user to urinate without removing the cup from the underpant.

2. Description of Related Art

A variety of protective undergarments are used by participants in many sports. For example, athletic supporters or "jock straps" are commonly used by male athletes to provide support and, to some extent, protection from impacts, for the groin area. In contact sports such as football and hockey, and in non-contact sports such as baseball and soccer where there is the potential of injury from fast moving balls or other equipment, a protective cup is also often utilized to provide greater protection to the groin area from impact injuries.

Typically, a supporter garment is used to retain the protective cup in position on the wearer. The standard supporter garment includes an elastic waist strap, two leg straps and a pouch for holding the cup. Other types of supporter garments have been developed. For example, U.S. Pat. No. 5,274,854 to Wenner, et al. discloses an athletic support short having a cup-retaining pouch attached at its top to the waistband of the shorts, and at its bottom to the crotch of the shorts. U.S. Pat. No. 3,788,314 to Noreen and U.S. Pat. No. 5,134,726 to Ross disclose similar protective pants-like garments which include a pouch for holding a protective cup in position over a wearer's groin.

Each of the above-described protective garments has been found to suffer the disadvantage that the male wearer cannot comfortably urinate while wearing the garment. Typically, in order to urinate, the wearer must remove the cup from its pouch and lower the garment. Because the support garment is most often fitted to be snug on the wearer so that the cup does not shift out of position during use, lowering the garment to urinate in this manner can be awkward and uncomfortable.

Thus, it can be seen that a need exists for an athletic support and protective garment capable of securely retaining a protective cup over the wearer's groin, which garment permits the wearer to urinate while wearing the garment without undue difficulty or discomfort. It is to the provision of such a garment that the present invention is primarily directed.

SUMMARY OF THE INVENTION

The disadvantages of the prior art are overcome by the present invention which, in one embodiment, is an athletic support and protective undergarment for males comprising a wearable body portion having a waistband for securement about a wearer's waist, two leg openings, a crotch portion located between the leg openings, and a front portion extending between the waistband and the crotch portion. The body portion of the undergarment defines an interior between the waistband and the leg openings. The undergarment further includes a pouch for retaining a protective cup, which pouch has a top and a bottom, and extends generally from the waistband to the crotch portion. The pouch further includes means—such as an elastic material, a hook-and-loop fastening system, or one or more snap fasteners—for retaining the protective cup in a generally fixed position on the front portion of the undergarment. In order to allow the wearer to urinate without removing the garment and without undue difficulty or discomfort, an opening in the form of a slit is provided in the front portion of the undergarment to provide access to the interior of the body portion of the garment. Preferably, this slit is adjacent one edge of the pouch.

A further embodiment of the present invention provides the undergarment's body portion with a back portion extending between the waistband and the crotch portion, generally opposite the undergarment's front portion.

The undergarment's pouch can be constructed in a number of ways. For example, a pouch panel can be stitched to the front portion of the undergarment at the lower and side edges of the pouch panel. In this manner, an opening is formed at the top of the pouch panel to allow a protective cup to be inserted into and removed from the space between the pouch panel and the front portion. In another aspect of the present invention, the pouch can be separately fabricated and thereafter attached to the body portion.

In another embodiment of the present invention, the protective undergarment includes a wearable body portion having a waistband for securement about a wearer's waist, two leg openings, a crotch portion located between the leg openings, a front portion extending between the waistband and the crotch portion, and a back portion extending between the waistband and the crotch portion and generally opposite the front portion. In this manner, the body portion defines an interior between the waistband and the leg openings. This embodiment of the present invention can further include a pouch secured to the front portion of the undergarment's body portion, such as by stitching, for retaining a protective cup in a generally fixed position on the front portion. The pouch preferably has a top, a bottom, and first and second sides. An opening in the pouch allows insertion and removal of the protective cup. Means can also be provided—such as an elastic material, a hook-and-loop fastening system, or one or more snap fasteners—for releasably retaining the protective cup within the pouch. A slit is provided through the front portion of the undergarment's body portion to allow access to the interior of the body portion. The slit is preferably adjacent and generally parallel to one side of the pouch. In one embodiment, the wearable body portion and the pouch of the undergarment are fabricated from 100% cotton material. Alternatively, the undergarment can be fabricated from a synthetic material or a synthetic/natural blend.

These and other aspects of the invention will become apparent from the following description of the preferred embodiments taken in conjunction with the drawing. As would be obvious to one skilled in the art, many variations and modifications of the invention may be effected without departing from the spirit and scope of the novel concepts of the disclosure.

BRIEF DESCRIPTION OF THE DRAWING FIGURE

The drawing FIGURE shows a front view of a protective garment according to a preferred form of the present invention.

DETAILED DESCRIPTION OF THE INVENTION

Referring now in detail to the drawing FIGURE, wherein like reference numbers indicate like parts throughout, a preferred embodiment of the invention will now be described in detail. As used in the description herein and throughout the claims, the following terms take the meanings explicitly associated herein, unless the context clearly dictates otherwise: "a," "an," and "the" include plural references and "in" includes "in" and "on."

As shown in the figure, the athletic support and protective undergarment 10 of the present invention generally comprises a wearable body portion 20, and a pouch 50. The wearable body portion 20 preferably comprises a waistband 22 around the upper edge of the body portion 20 for securing the undergarment about a wearer's waist. The waistband is preferably fabricated from a resilient material such as elastic, and is secured to the reminder of the body portion 20 by means of stitching 24 or by other attachment means. Alternatively, the waistband 22 can be fabricated as an integral part of the body portion 20. The waistband 22 is preferably of a sufficient width to allow for comfortable use by the wearer. The waistband 22 should be fabricated from a material having sufficient elasticity to retain the undergarment 10 securely on the wearer, and prevent undue shifting of the undergarment 10 when in use.

The body portion 20 preferably further comprises two leg openings 26, 28, through which the wearer's legs will extend when the undergarment is in use. Banding 30 can be provided about the leg openings 26, 28, for increased comfort and durability. The banding is preferably of cotton fabric. Alternatively, a synthetic or blended material can be utilized.

In preferred form, the body portion 20 of the undergarment 10 further comprises a crotch portion 34 located generally between leg openings 26, 28. In the depicted embodiment, the leg openings 26, 28, are generally alongside and above the crotch portion 34. In an alternate embodiment, the leg openings can extend below the crotch portion 34 to form shorts or leggings.

The body portion 20 of the undergarment 10 of the present invention preferably further comprises a front portion 36 extending between the waistband 22 and the crotch portion 34. When the user dons the undergarment 10 of the present invention, the front portion 36 will preferably cover the user's lower front torso and groin area. The front portion 36 of the undergarment 10 of the present invention can be formed as a separate panel, or can comprise an integral part of the body portion 20 of the undergarment 10. In preferred form, the front portion 36 is fabricated from a 100% cotton material. Alternatively, the front portion 36 can be fabricated from a synthetic or blended material.

The body portion 20 of the undergarment 10 of the present invention can further comprise a back portion 38 extending between the waistband 22 and the crotch portion 34 of the body portion 20. The back portion 38 is generally opposite the front portion 36, and can be formed as a separate back panel, or as an integral part of the overall body portion 20. The back portion 38 can be fabricated from the same types of materials of construction as the front portion 36. The inclusion of the back portion 38 provides improved comfort and protection, such as from abrasions during sliding, over existing athletic supporters.

As seen in the drawing figure, the body portion 20 of the present invention defines an interior 42 generally between the waistband 22 and the leg openings 26, 28. This interior 42 is generally contoured to fit the wearer's lower torso and groin area in a comfortable but snug manner.

The undergarment 10 of the present invention preferably further comprises a pouch 50 secured to the front portion 36 of the body portion 20. The pouch 50 can be attached to the body portion 20 by stitching or other attachment means, or can be integrally formed with the body portion 20. The pouch 50 is generally contoured and positioned to retain a protective cup of standard design in a generally fixed position on the front portion 36 of the undergarment 10, over the wearer's genital region. In preferred form, the pouch 50 is generally triangular or trapezoidal in shape, having a top 52, a bottom 54, and first and second sides 58. The pouch 50 extends generally from adjacent the waistband 22 to adjacent the crotch portion 34, the top 52 of pouch 50 being generally adjacent the waistband 22 and the bottom 54 of pouch 50 being generally adjacent the crotch portion 34.

The pouch 50 can be formed by attaching a pouch panel 62 to the front portion 36 by stitching or other attachment means. The pouch panel preferably comprises an upper edge, a lower edge, and first and second side edges, generally corresponding to the top 52, the bottom 54, and the first and second sides 56, 58 of the pouch 50, respectively. The pouch is preferably fabricated from a 100% cotton fabric. Alternatively, the pouch 50 can be constructed of a synthetic or blended fabric. The pouch panel 62 is preferably attached to the front portion 36 at least along its lower edge and its first and second side edges. In this manner, the upper edge of the pouch panel 62 remains free, thereby forming an opening 64 for allowing a protective cup to be inserted into or removed from the pouch 50. Alternatively, a protective cup can be permanently installed in the pouch 50, and the upper edge of the pouch panel 62 secured to the front portion 36 of the body portion 20 in a permanently manner. In an alternate embodiment of the present invention, the pouch 50 can be formed by fabricating a separate sleeve-like pouch for containing a protective cup, and attaching that sleeve-like pouch to the front portion 36 of the undergarment 10.

In preferred form, the pouch 50 comprises an opening 64 adjacent its top 52 for allowing the insertion and/or removal of a protective cup. The pouch preferably further comprises means for retaining the protective cup in a generally fixed position on the front portion 36 of the undergarment 10, over the wearer's genitals. This means for retaining the protective cup in a generally fixed position on the front portion 36 preferably comprises means for releasably retaining the upper edge or top 52 of the pouch 50 against, or in close proximity to, the front portion 36 of the body portion 20. In this manner, the protective cup is retained releasably within the pouch 50.

In preferred form, the means for releasably retaining the upper edge or top 52 of the pouch 50 against the front portion 36 of the body portion 20 comprises an elastic material secured to the upper edge or top 52 of the pouch panel 62. The elastic material 66 can be attached to the pouch panel 62 by means of stitching, or by alternate attachment means. The elasticity of the elastic material 66 urges the top 52 of the pouch panel 62 against, or in close proximity to, the front portion 36 of the body portion 20, thereby preventing unintentional dislodging of the cup.

In an alternate embodiment of the present invention, the means for releasably retaining the upper edge or top 52 of the pouch panel 62 against the front portion 36 of the body portion 20 can comprise a hook-and-loop fastening system 59 having a first component secured to the upper edge or top 52 of the pouch panel 62, and a second component secured to the front portion 36 of the body portion 20. In this manner, the first and second components of the hook-and-loop fastening system can be engaged to retain the protective cup in a generally fixed position on the front portion 36 of the body portion 20 within the pouch 50. In a second alternate embodiment, one or more snap fasteners 61 can be provided, each having a first snap component secured to the upper edge or top 52 of the pouch panel 62 and a second snap component secured to the front portion 36 of the body portion 20. In this manner, the first and second snap component can be releasably engaged to retain the protective cup in a generally fixed position on the front portion 36 of the body portion 20 within the pouch 50.

In preferred form, the undergarment 10 of the present invention further comprises an opening such as a slit 80 through the front portion 36 of the body portion 20, for allowing access to the interior 42 of the body portion 20. The provision of the slit 80 allows the wearer to urinate while wearing the undergarment 10, within removing the protective cup or lowering the undergarment 10, and without undue discomfort or difficulty. The slit 80 is preferably provided generally adjacent and parallel to the first side 56 of the pouch 50, opposite the second side 58 of the pouch 50. An overlap portion (not shown) of the front portion 36 of the body portion 20 preferably overlaps the slit 80 somewhat to eliminate any gap or opening in the front portion 36 during normal use.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. An athletic support and protective undergarment comprising:

a. a wearable body portion having a waistband for securement about a wearer's waist, two leg openings, a crotch portion located between said leg openings, and a front portion extending between said waistband and said crotch portion and having an exterior surface and an interior surface adjacent the wearer's groin area, said body portion defining an interior between said waistband and said leg openings;

b. a pouch on said exterior surface of said front portion for retaining a protective cup, said pouch having a top and a bottom and extending generally from said waistband to said crotch portion, said pouch further comprising means for retaining the protective cup in a generally fixed position on said front portion; and c. an opening being formed through said front portion adjacent said pouch for allowing access to said interior of said body portion.

2. An undergarment as in claim 1, further comprising a back portion extending between said waistband and said crotch portion, and generally opposite said front portion.

3. An undergarment as in claim 2, wherein said leg openings extend below said crotch portion.

4. An undergarment as in claim 1, wherein said pouch comprises a pouch panel having an upper edge, a lower edge, and first and second side edges, and wherein said pouch panel is secured to said front portion of said body portion by at least said lower edge and said first and second side edges.

5. An undergarment as in claim 4, wherein said front portion and said pouch panel are constructed of 100% cotton material.

6. An undergarment as in claim 4, wherein said pouch panel is secured to said front portion of said body portion by stitching.

7. An undergarment as in claim 4, wherein said opening through said front portion is adjacent and generally parallel to said first side edge of said pouch panel, opposite said second side edge of said pouch panel.

8. An undergarment as in claim 4, further comprising an opening in said pouch for allowing insertion and removal of the protective cup, said opening being adjacent said upper edge of said pouch panel.

9. An undergarment as in claim 8, wherein said means for retaining the protective cup comprises means for releasably retaining said upper edge of said pouch panel against said front portion of said body portion.

10. An undergarment as in claim 9, wherein said means for releasably retaining said upper edge of said pouch panel against said front portion of said body portion comprises an elastic material secured to said upper edge of said pouch panel.

11. An undergarment as in claim 9, wherein said means for releasably retaining said upper edge of said pouch panel against said front portion of said body portion comprises a hook-and-loop fastening system having a first component secured to said upper edge of said pouch panel and a second component secured to said front portion of said body portion for releasably engaging said first component.

12. An undergarment as in claim 9, wherein said means for releasably retaining said upper edge of said pouch panel against said front portion of said body portion comprises at least one snap fastener having a first snap component secured to said upper edge of said pouch panel and a second snap component secured to said front portion of said body portion for releasably engaging said first snap component.

13. An athletic support and protective undergarment comprising:

a. a wearable body portion having a waistband for securement about a wearer's waist, two leg openings, a crotch portion located between said leg openings, a front portion having an exterior surface and an interior surface adjacent the wearer's groin area and extending between said waistband and said crotch portion, and a back portion extending between said waistband and said crotch portion and generally opposite said front portion, said body portion defining an interior between said waistband and said leg openings;

b. a pouch for retaining a protective cup in a generally fixed position on said exterior surface of said front portion, said pouch having a top, a bottom and first and second sides, said pouch further comprising an opening allowing insertion and removal of the protective cup and means for releasably retaining the protective cup within said pouch, said opening being adjacent said top of said pouch;

c. an opening through said front portion for allowing access to the interior of said body portion, wherein said opening is adjacent and generally parallel to said first side of said pouch, opposite said second side of said pouch.

14. An undergarment as in claim 13, wherein said leg openings extend below said crotch portion.

15. An undergarment as in claim 13, wherein said wearable body portion and said pouch are 100% cotton material.

16. An undergarment as in claim 13, wherein said pouch is secured to said front portion of said body portion by stitching.

17. An undergarment as in claim 13, wherein said means for releasably retaining the protective cup within said pouch comprises an elastic material secured to said opening in said pouch.

18. An undergarment as in claim 13, wherein said means for releasably retaining the protective cup within said pouch comprises a hook-and-loop fastening system.

19. An undergarment as in claim 13, wherein said means for releasably retaining the protective cup within said pouch comprises at least one snap fastener.

20. An athletic support and protective undergarment comprising:

a. a wearable body portion having a waistband for securement about a wearer's waist, two leg openings, a crotch portion located between said leg openings, a front portion having an exterior surface and an interior surface adjacent the wearer's groin area and extending between said waistband and said crotch portion, and a back portion extending between said waistband and said crotch portion, and generally opposite said front portion, said body portion defining an interior between said waistband and said leg openings;

b. a pouch secured to said front portion of said body portion by stitching, for retaining a protective cup in a generally fixed position on said front portion, said pouch having a top, a bottom, and first and second sides, said pouch further comprising an opening allowing insertion and removal of the protective cup and means for releasably retaining the protective cup within said pouch, said opening being adjacent said top of said pouch;

c. an opening through said front portion for allowing access to the interior of said body portion, wherein said opening is adjacent and generally parallel to said first side of said pouch, opposite said second side of said pouch;

wherein said wearable body portion and said pouch are 100% cotton material, and wherein said means for releasably retaining the protective cup within said pouch is selected from the group consisting of: (i) an elastic material secured to said opening in said pouch, (ii) a hook-and-loop fastening system, and (iii) at least one snap fastener.

* * * * *